US009933163B2

(12) United States Patent
Pasqualotto et al.

(10) Patent No.: US 9,933,163 B2
(45) Date of Patent: Apr. 3, 2018

(54) COMBUSTOR ARRANGEMENT WITH SLIDABLE MULTI-CONE PREMIX BURNER

(71) Applicant: ALSTOM Technology Ltd, Baden (CH)

(72) Inventors: Ennio Pasqualotto, Winterthur (CH); Pirmin Schiessel, Ehrendingen (CH); Hellat Jaan, Baden-Rütihof (CH)

(73) Assignee: ANSALDO ENERGIA SWITZERLAND AG, Baden (CH)

( * ) Notice: Subject to any disclaimer, the term of this patent is extended or adjusted under 35 U.S.C. 154(b) by 822 days.

(21) Appl. No.: 13/937,574

(22) Filed: Jul. 9, 2013

(65) Prior Publication Data

US 2014/0013761 A1 Jan. 16, 2014

(30) Foreign Application Priority Data

Jul. 10, 2012 (EP) ..... 12175642

(51) Int. Cl.
*F23R 3/28* (2006.01)
*F23C 5/06* (2006.01)
*F23C 7/00* (2006.01)

(52) U.S. Cl.
CPC ..... *F23R 3/286* (2013.01); *F23C 5/06* (2013.01); *F23C 7/002* (2013.01); *F23C 2900/07002* (2013.01)

(58) Field of Classification Search
CPC .... F23R 3/286; F23R 3/14; F23R 3/12; F23R 2900/00012; F23C 7/002; F23C 5/06; F23C 2900/07002; F23C 2900/07001
See application file for complete search history.

(56) References Cited

U.S. PATENT DOCUMENTS 3,656,692 A 4/1972 Flournoy et al.
4,561,841 A 12/1985 Korenyi
4,781,030 A * 11/1988 Hellat ..... F23D 11/402 431/350
5,735,687 A * 4/1998 Knopfel ..... F23C 7/002 431/115
5,738,508 A * 4/1998 Dobbeling ..... F23C 7/002 431/173
5,738,509 A * 4/1998 Marling ..... F15D 1/00 431/173
5,954,496 A * 9/1999 Dobbeling ..... F23C 7/002 431/115

(Continued)

FOREIGN PATENT DOCUMENTS

DE 195 45 310 6/1997
EP 0 704 657 4/1996

(Continued)

*Primary Examiner* — Pascal M Bui Pho
*Assistant Examiner* — Stefan Ibroni
(74) *Attorney, Agent, or Firm* — Buchanan Ingersoll & Rooney PC

(57) ABSTRACT

A combustor arrangement includes a combustion chamber with a front panel, and a premix burner of the multi-cone type, which is connected to the front panel through an elongated mixing zone in an axially moveable fashion by a sealed sliding joint. A wide range of axial variation of the burner with a minimized influence of the leakage air flow on the oxidation process within the flame is achieved by positioning the sealed sliding joint upstream of the mixing zone.

12 Claims, 3 Drawing Sheets

(56) References Cited

U.S. PATENT DOCUMENTS

| | | | | | |
|---|---|---|---|---|---|
| 5,980,240 | A * | 11/1999 | Krautzig | F23C 7/002 | 431/285 |
| 6,019,596 | A * | 2/2000 | Knopfel | F23C 7/002 | 431/350 |
| 6,702,574 | B1 * | 3/2004 | Dobbeling | F23C 7/002 | 239/403 |
| 7,632,091 | B2 * | 12/2009 | Steinbach | F23C 7/002 | 431/350 |
| 8,950,187 | B2 * | 2/2015 | Pasqualotto | F23R 3/286 | 60/737 |
| 9,562,687 | B2 * | 2/2017 | Johnson | F23R 3/04 | |
| 2007/0042307 | A1 * | 2/2007 | De Marcos | F23R 3/286 | 431/350 |
| 2008/0115497 | A1 * | 5/2008 | Eroglu | F23C 7/002 | 60/737 |
| 2013/0232977 | A1 * | 9/2013 | Siddagangaiah | F23R 3/14 | 60/737 |

FOREIGN PATENT DOCUMENTS

| | | |
|---|---|---|
| EP | 0 851 172 | 7/1996 |
| EP | 0 851 172 | 7/1998 |
| EP | 0 918 191 | 5/1999 |
| EP | 1 524 469 | 4/2005 |
| EP | 2 423 597 | 2/2012 |
| RU | 1835031 C | 8/1993 |
| RU | 81489 U1 | 3/2009 |
| WO | 2010/136287 A2 | 12/2010 |

* cited by examiner

*Fig.1* *Prior Art*

COMBUSTOR ARRANGEMENT WITH SLIDABLE MULTI-CONE PREMIX BURNER

CROSS-REFERENCE TO RELATED APPLICATION

This application claims priority to European Application 12175642.3 filed Jul. 10, 2012, the contents of which is hereby incorporated in its entirety.

TECHNICAL FIELD

The present invention relates to the combustion technology. It refers to a combustor arrangement, especially for a gas turbine, according to the preamble of claim 1.

BACKGROUND

In the past more than 20 years burners with short but effective premixing zones (so-called EV burners: environmental friendly V-shaped burners) have been implemented in several gas turbines of the applicant, with very low NOx levels. In addition to this, three variants of premix technologies have been successfully developed and deployed into those gas turbine engines: the sequential EV burners —a technology that allows premixing of natural gas and oil into a hot exhaust stream to reheat the exhaust gases of a first high pressure turbine; the MBtu EV burners that are used to burn syngas in a premix flame with low NOx emissions; and the advanced EV burners (AEV) that are capable to prevaporize and premix liquid fuel prior to combustion and burn it with very low NOx emissions without water injection.

Document EP 0 851 172 A2 discloses an exemplary EV burner of the double-cone type, for operating a combustion chamber with a liquid and/or gaseous fuel, whereby the combustion air required for this purpose is directed through tangential air-inlet ducts into an interior space of the burner. This directing of the flow results in a swirl flow in the interior space, which swirl flow induces a backflow zone at the outlet of the burner. In order to stabilize the flame front forming there, at least one zone is provided at each sectional body forming the burner, within which zone inlet openings are provided for the injection of supplementary air into the swirl flow. Due to this injection, a film forms at the inner wall of the sectional bodies, which film prevents the flame from being able to flashback along the inner wall of the sectional bodies into the interior space of the burner.

Document EP 2 423 597 A2 shows another exemplary EV burner in the form of a double-cone burner, which has two partial cone shells which are arranged nested one inside the other, forming air inlet ducts between them, through which combustion air from the outside flows into a conical inner space of the premix burner. Linear rows of holes of injection openings, which extend transversely to the flow direction of the combustion air, are arranged on the outer walls of the air inlet ducts and through which a gaseous fuel is injected into the combustion air which flows past transversely to them.

Document DE 195 45 310 A1 discloses a further premixing burner consisting of a hollow cone with an outer and inner cone casing. At least two inlet ducts run at a tangent to the inner cone casing and are positioned along a straight cone casing line. The part cone axes of the part shells formed lie on the same cone axis. The pre-mixing burner is divided into at least two, for example four, parts containing the inlet ducts so as to swirl the combustion air. A fuel nozzle is positioned at the cone tip for injecting liquid fuel.

Document EP 0 704 657 A2 describes a combustor arrangement, which is shown in FIG. 1. The combustor arrangement comprises a premix burner 11 with a swirler 15 and a mixing tube 14. The swirler 15 has a conical structure which is repeatedly acted upon by a combustion-air flow 19 entering tangentially. The flow forming herein, with the aid of a transition geometry provided downstream of the swirler 15, is passed smoothly into a transition piece 16 in such a way that no separation regions can occur there. The transition piece 16 is extended on the outflow side of the transition geometry by the mixing tube 14, the transition piece 16 and the tube 14 forming the actual mixing zone of the burner. The transition piece 16 and the mixing tube 14 are connected by a ring 18. Furthermore, transition passages 201 bridge the difference in cross-section without at the same time adversely affecting the flow formed.

A combustion chamber 12 adjoins the end of the mixing tube 14, there being a jump in cross-section between the two cross-sections of flow. Only here does a central backflow zone form, which has the properties of a flame retention baffle. The combustion chamber 12 has a front panel 13 with an opening for receiving the end of the mixing tube 14.

As shown in FIG. 1, in principle, to lower NOx formation, the fuel air mixing can be extended in a mixing tube flow 20 by applying such a mixing tube 14 at the exit of a swirler 15 prior to the sudden area expansion entering the combustion chamber 12 where the flame is stabilized by the recirculating flow. The air slots and gas channels of the swirlers 15 are confined in the downstream part by an intersecting plane orthogonal to the burner axis. Therefore the swirler exit is not circular and needs the special transition piece 16 in-between the swirler 15 and the cylindrical mixing tube 14. This transition piece is prone to flash-back as it must apply a complicated 3D shape to avoid flow separation and flame stabilization in recirculation zones.

The gas turbine burner is usually mounted to the combustion chamber such that it can move in axial direction to compensate for thermal expansion. Leakages through the seals applied between the burner and the front panel of the combustion chamber are close to the flame and cause disturbances to the oxidation process. An additional problem is caused by the approach flow to the burner which is subject to flow disturbances due to the narrow space within the combustor hood.

Thus, the current state-of-the-art distinguishes between the front panel 13 of the combustion chamber 12 and the burner 11. To minimize air leakages, a seal is applied, which however is not tight, since the burner 11 and combustion chamber 12 are subject to large temperature changes and the burner 11 must be axially movable with regard to the front panel 13. Since this seal is close to the flame at the exit of the burner the leakage air is disturbing the oxidation process of the flame by local flame quenching effects. To even out the approach flow, currently, a sieve is shrouded around the burner, however, causing a pressure drop to the air flow.

SUMMARY

It is an object of the present invention to provide a combustor arrangement, which avoids the disadvantages of known arrangements and combines a wide range of axial variation of the burner with a minimized influence of the leakage air flow on the oxidation process within the flame.

This and other objects are obtained by a combustor arrangement according to claim 1

The combustor arrangement according to the invention comprises a combustion chamber with a front panel, and a premix burner of the multi-cone type, which is connected to said front panel though an elongated mixing zone in an axially moveable fashion by means of a sealed sliding joint.

It is characterized in that said sealed sliding joint is positioned upstream of said mixing zone.

According to an embodiment of the invention the sealed sliding joint is made up by a coaxial sliding arrangement of a cylindrical burner ring and an essentially cylindrical burner sleeve, whereby said burner ring is fixed to said burner and said burner sleeve is fixed to and part of said front panel, and a seal is provided between said burner ring and burner sleeve.

Specifically, said burner ring is surrounded by said burner sleeve.

More specifically, said burner ring extends upstream of the downstream end of the burner, and the seal is positioned at the upstream end of the burner ring.

According to another embodiment of the invention the burner sleeve has a conically widening burner outlet at the transition to said combustion chamber.

According to a further embodiment of the invention purge air holes are provided in the burner sleeve downstream of the seal to purge the gap between burner ring and burner sleeve with air.

According to just another embodiment of the invention said premix burner comprises a plurality of burner shells, which are arranged around a central burner axis and are parts of a virtual, axially extending common cone, which opens in a downstream direction, whereby said parts are displaced perpendicular to said burner axis such that a tangential slot is defined between each pair of adjacent shells, that each of the shells is equipped with a premix gas channel extending along an axially oriented edge of the respective shell such that a gas can be injected from said premix gas channel through gas injection holes into a stream of air entering the interior of the arrangement of shells through the adjacent slot, that the downstream ends of the shells and premix gas channels are bordered by intersecting planes, which are defined by intersecting said shells and premix gas channels with a virtual coaxial cylinder of a predetermined radius, and that said burner ring+has an inner radius similar to said predetermined radius.

BRIEF DESCRIPTION OF THE DRAWINGS

The present invention is now to be explained more closely by means of different embodiments and with reference to the attached drawings.

DETAILED DESCRIPTION

As explained in the introductory part, the air leakage flow through the front panel sealing of existing EV and AEV burners bypasses the initial flame zone and is mixed later into the hot gas without premixing before with fuel. It is therefore detrimental for both NOx and CO production.

Figure 4:
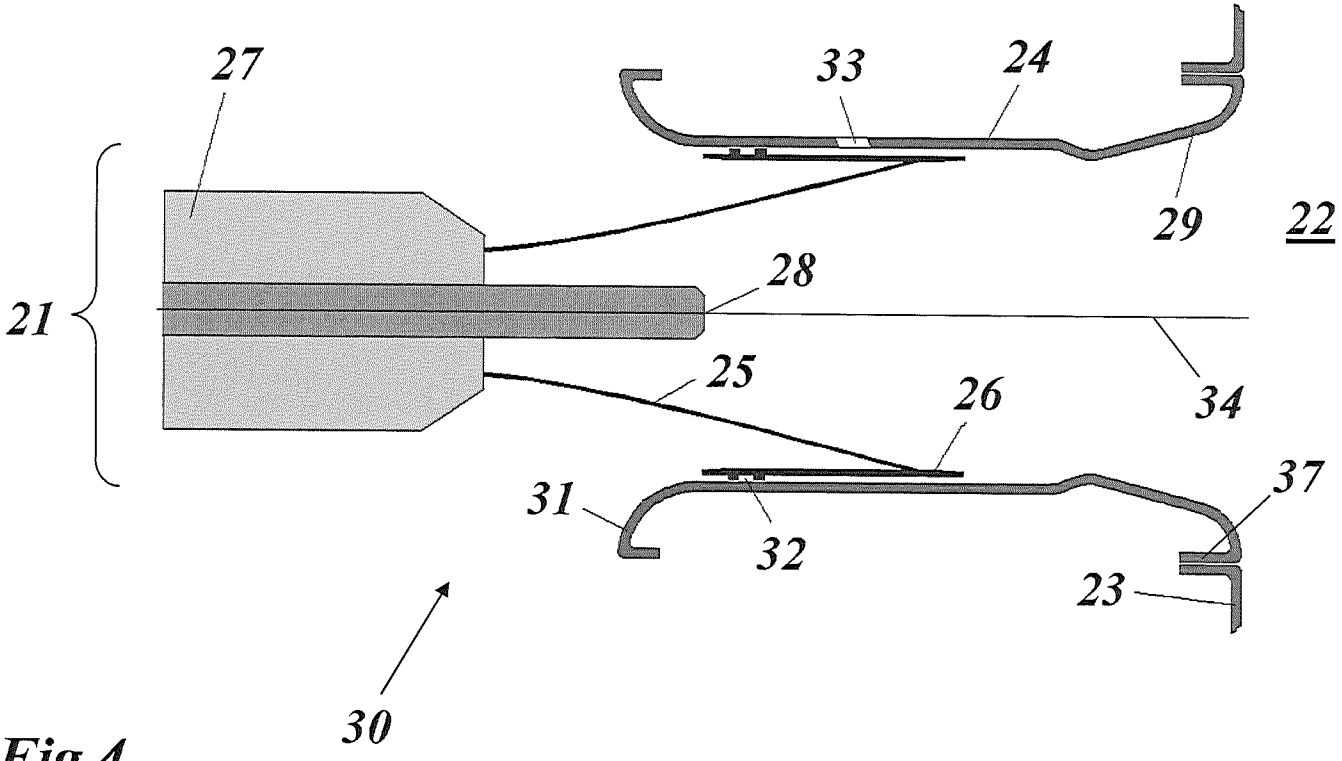
FIG. 4 shows in a sectional view a combustor arrangement according to an embodiment of the invention with a sliding joint as shown in FIG. 3.

By contrast, in the combustor arrangement according to the invention, an embodiment of which is shown in FIG. 4, the air leakages through the extractable burner parts and the sleeve are used on purpose, first to purge the gap between the sleeve and the burner ring and thus prevent flame stabilization at the burner ring's exit border. The air is then discharged into the mixing zone of the sleeve where it has sufficient time for premixing with the other fuel-air mixture before it reaches the flame zone stabilized at the diffuser type outlet of the burner sleeve.

Figure 1:
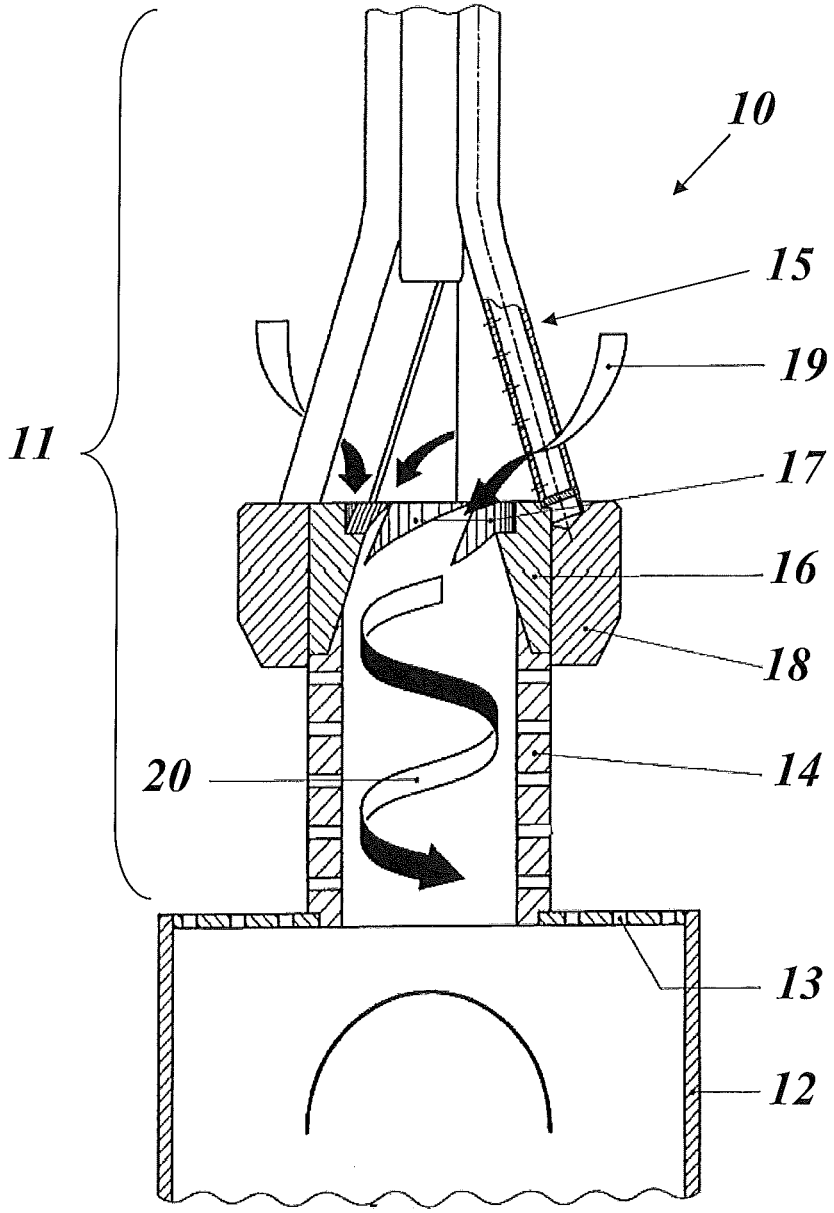
FIG. 1 shows a known combustor arrangement according to document EP 0 704 657 A2.
Figure 2:
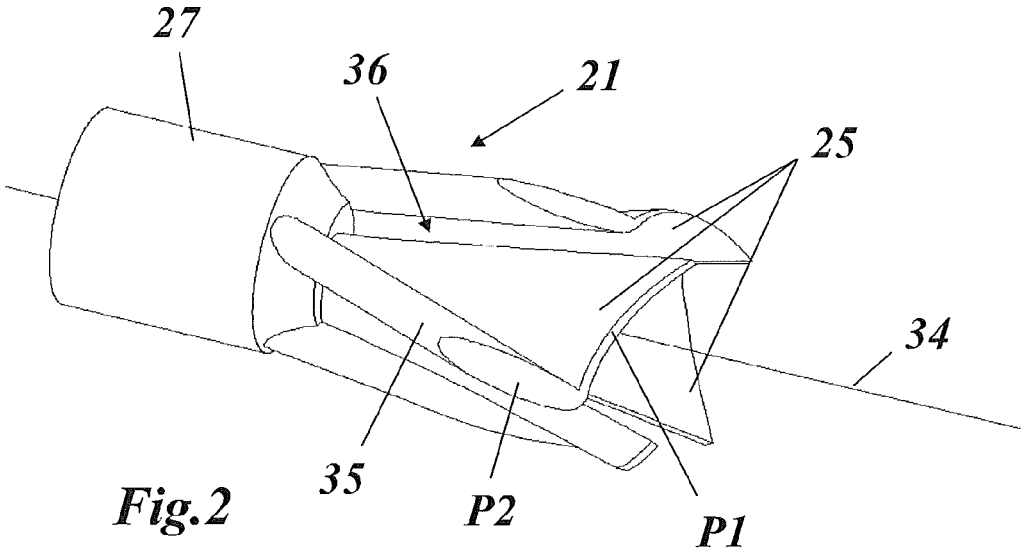
FIG. 2 shows in a perspective view a burner, which can be advantageously used in a combustor arrangement according to the invention.

According to FIG. 4, a combustor arrangement 30 comprises a premix burner 21 extending along a central burner axis 34, and being equipped with a fuel lance 27 and a swirler configuration, which is shown in FIG. 2.

The swirler configuration of FIG. 2 consists of burner shells 25, which are arranged around the central burner axis 34 and are parts of a virtual, axially extending common cone (not shown), which opens in a downstream direction, whereby said parts or shells 25 are displaced perpendicular to said burner axis 34 such that a tangential slot 36 is defined between each pair of adjacent shells 25.

Each of the shells 25 is equipped with a premix gas channel 35 extending along an axially oriented edge of the respective shell such that a fuel gas can be injected from said premix gas channel 35 through gas injection holes (not shown) into a stream of air entering the interior of the arrangement of shells 25 through the adjacent slot 36.

The downstream ends of the shells 25 and premix gas channels 35 are bordered by intersecting planes P1 and P2, respectively, which are defined by intersecting said shells 25 and premix gas channels 35 with a virtual coaxial cylinder of a predetermined radius.

Figure 3:
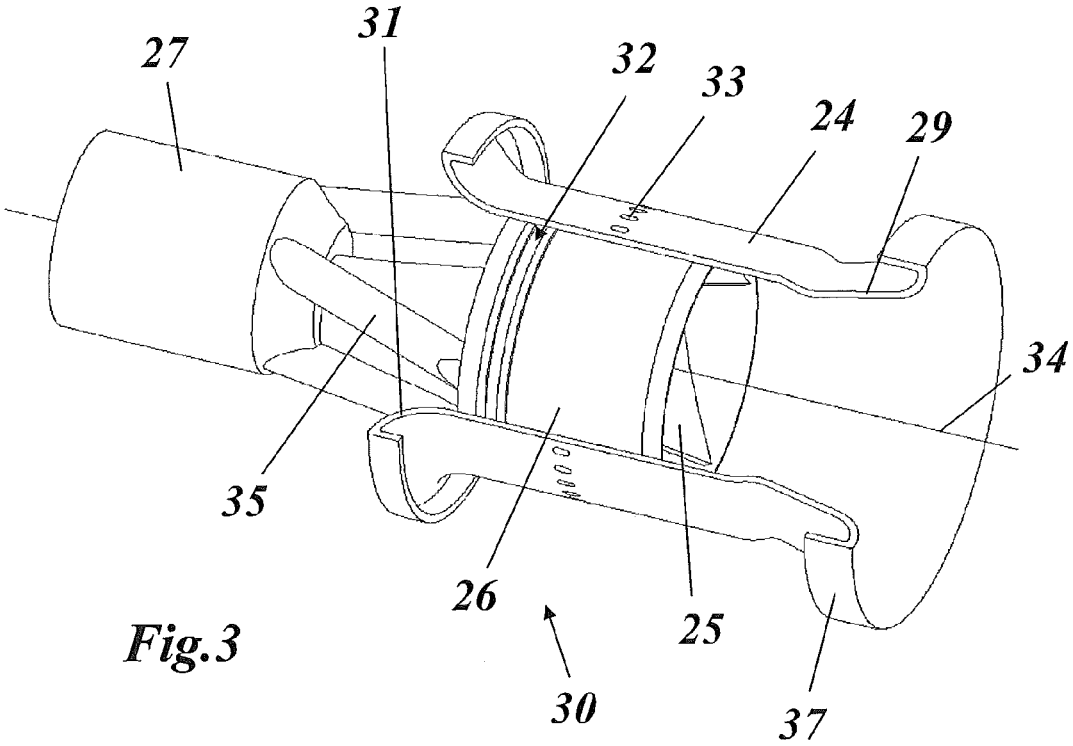
FIG. 3 shows the burner of FIG. 2 equipped with a sliding joint in accordance with an embodiment of the invention.

As shown in FIGS. 3 and 4, the swirler arrangement is surrounded by a cylindrical burner ring 26, which has an inner radius similar to said predetermined radius of said virtual cylinder. The burner ring 25 is fixed to the swirler arrangement and extends upstream of the downstream end of the burner 21 or swirler arrangement, respectively. in the centre of the swirler arrangement a fuel injector 28 is provided for injecting premix oil and/or pilot gas.

The burner 21 with its burner ring 26 is slideably mounted in a coaxial burner sleeve 24. A seal 32 of the labyrinth type is positioned at the upstream end of the burner ring 26 between the burner ring 26 and the surrounding burner sleeve 24. The burner sleeve 24 has a conically widening burner outlet 29 at its downstream end and is fixed to a front panel 23 of the combustion chamber 22 (FIG. 4) with a circular flange 37. Further, the burner sleeve 24 has a bell-shaped air inlet 31 at its upstream end to guide combustion air into the swirler arrangement.

Downstream of the seal 32 the burner sleeve 24 is equipped with an annular series of purge air holes 33, through which purge air can enter into an purge the gap between the burner ring 26 and the burner sleeve 24.

The use of the burner sleeve 24 mounted on the front panel 23 of the combustion chamber 22 makes the axial position of the gas turbine burner 21 axially adjustable. It improves air velocity profiles along the burner slots 36 by directing with its air inlet 31 an air approach flow in axial direction and at the same time formes a mixing tube, where air leakages are mixed with fuel sufficiently far upstream in comparison to the flame. The burner sleeve 24 takes on the function of the burner mixing tube but is introduced as part of the front panel 23, avoiding the leakage problem mentioned above. Since the burner 21 is sliding inside the sleeve 24, there will be again a leakage, which, however is not harmful, as the leakage air is added upstream of the mixing tube and will take part in the mixing process upstream of the flame.

Summarized, long cylindrical sleeves 24 shrouding the burners 21 are part of the combustor front panel 23. These sleeves 24 have a bell-shaped mouth or air inlet 31 to guide the air flow with a strong axial component to the burner slots 36. The sleeves 24 have radial air inlets or purge air holes 33 to purge the radial gap between the sleeves 24 and the burner rings 26 and to prevent flame stabilisation at the burner ring exit. Contrary to the existing AEV burner, the mixing zone is not part of the extractable burner 21 since the sleeves 24 themselves form the burner mixing zones before the outlet to the combustion chamber 22. At the outlet the sleeves have a diffuser shape (burner outlet 29) to better stabilize the flame.

What is claimed is:

1. A combustor arrangement, comprising:

a combustion chamber with a front panel, and a premix burner of a multi-cone type, which is connected to said front panel through an elongated mixing zone in an axially moveable fashion by a sealed slidable joint, wherein said sealed slidable joint is positioned upstream of said mixing zone, wherein the sealed slidable joint is made up by a coaxial sliding arrangement of a cylindrical burner ring and an essentially cylindrical burner sleeve, the essentially cylindrical burner sleeve defining an axial direction and a radial direction perpendicular to said axial direction, wherein said burner ring is fixed to said premix burner and said burner sleeve is fixed to and part of said front panel, and a seal is located between said burner ring and said burner sleeve in the radial direction, and wherein the seal is arranged to be slidable, in the axial direction, along and against a surface of the burner ring or the burner sleeve during relative movement of the burner ring and the burner sleeve such that the entirety of the seal is located within the essentially cylindrical burner in the radial direction and circumferentially surrounds the burner ring.

2. The combustor arrangement according to claim 1, wherein said burner ring is surrounded by said burner sleeve.

3. The combustor arrangement according to claim 2, wherein said burner ring extends upstream of the downstream end of the burner, and the seal is positioned at the upstream end of the burner ring.

4. The combustor arrangement according to claim 1, wherein the burner sleeve has a conically widening burner outlet at the transition to said combustion chamber.

5. The combustor arrangement according to claim 3, wherein the burner sleeve includes purge air holes downstream of the seal to purge the gap between burner ring and burner sleeve with air.

6. The combustor arrangement according to claim 1, wherein said premix burner comprises:

a plurality of burner shells, which are arranged around a central burner axis and are parts of a virtual, axially extending common cone, which opens in a downstream direction, and wherein said parts are displaced perpendicular to said burner axis such that a tangential slot is defined between each pair of adjacent shells, and wherein each of the shells is equipped with a premix gas channel extending along an axially oriented edge of the respective shell such that a gas can be injected from said premix gas channel through gas injection holes into a stream of air entering the interior of the arrangement of shells through the adjacent slot, and wherein the downstream ends of the shells and premix gas channels are bordered by intersecting planes, which are defined by intersecting said shells and premix gas channels with a virtual coaxial cylinder of a predetermined radius, and wherein said burner ring has an inner radius similar to said predetermined radius.

7. A combustor arrangement, comprising:

a combustion chamber with a front panel; and a premix burner of a multi-cone type, which is connected to said front panel through an elongated mixing zone in an axially moveable fashion by a sealed slidable joint;

wherein said sealed slidable joint is positioned upstream of said mixing zone;

wherein the sealed slidable joint is made up by a coaxial sliding arrangement of a cylindrical burner ring and an essentially cylindrical burner sleeve;

wherein said burner ring is fixed to said premix burner and said burner sleeve is fixed to and part of said front panel, and a seal is provided between said burner ring and said burner sleeve; and wherein the seal, the burner ring and the burner sleeve are arranged and configured such that the seal axially will slide along and against a surface of the burner ring or the burner sleeve during any axial relative movement of the burner ring and the burner sleeve such that the seal is located on a radially inner surface of the essentially cylindrical burner and on a radially outer surface of the burner ring.

8. The combustor arrangement according to claim 7, wherein said burner ring is surrounded by said burner sleeve.

9. The combustor arrangement according to claim 8, wherein said burner ring extends upstream of the downstream end of the burner, and the seal is positioned at the upstream end of the burner ring.

10. The combustor arrangement according to claim 7, wherein the burner sleeve has a conically widening burner outlet at the transition to said combustion chamber.

11. The combustor arrangement according to claim 9, wherein the burner sleeve includes purge air holes downstream of the seal to purge the gap between burner ring and burner sleeve with air.

12. The combustor arrangement according to claim 7, wherein said premix burner comprises:

a plurality of burner shells, which are arranged around a central burner axis and are parts of a virtual, axially extending common cone, which opens in a downstream direction, and wherein said parts are displaced perpendicular to said burner axis such that a tangential slot is defined between each pair of adjacent shells, and wherein each of the shells is equipped with a premix gas channel extending along an axially oriented edge of the respective shell such that a gas can be injected from said premix gas channel through gas injection holes into a stream of air entering the interior of the arrangement of shells through the adjacent slot, and wherein the downstream ends of the shells and premix gas channels are bordered by intersecting planes, which are defined by intersecting said shells and premix gas channels with a virtual coaxial cylinder of a predetermined radius, and wherein said burner ring has an inner radius similar to said predetermined radius.

* * * * *